US005297783A

United States Patent [19]

Howard et al.

[11] Patent Number: 5,297,783

[45] Date of Patent: Mar. 29, 1994

[54] APPARATUS AND SYSTEM FOR HANDLING CUT SHEETS AND WEB FORMS TO FORM DISCRETE BATCHES

[75] Inventors: Linda A. Howard, Stratford; Karel J. Janatka, Southbury, both of Conn.

[73] Assignee: Pitney Bowes Inc., Stamford, Conn.

[21] Appl. No.: 790,054

[22] Filed: Nov. 12, 1991

[51] Int. Cl.[5] ..... B65H 43/00; B65H 3/44

[52] U.S. Cl. ..... 270/52.5; 270/58; 270/59; 225/100; 271/9

[58] Field of Search ..... 270/32, 52, 52.5, 55, 270/57, 58, 59; 414/789.6; 225/100, 106

[56] References Cited

U.S. PATENT DOCUMENTS

| | | | |
|---|---|---|---|
| 2,218,217 | 10/1940 | Potdevin | 270/52 X |
| 2,744,562 | 5/1956 | La Rocca et al. | 270/59 X |
| 2,883,929 | 4/1959 | Eichenbaum et al. | 271/9 X |
| 3,966,186 | 6/1976 | Helm | 270/58 |
| 3,979,112 | 9/1976 | Munn et al. | 270/59 X |
| 4,618,085 | 10/1986 | Kimura et al. | 225/100 |
| 4,629,172 | 12/1986 | Kameyama et al. | 270/58 X |
| 4,696,464 | 9/1987 | Gammerler | 270/51 X |
| 4,800,505 | 1/1989 | Axelrod et al. | 270/58 X |
| 4,851,075 | 7/1989 | Parker | 225/100 X |
| 4,972,655 | 11/1990 | Ogawa | 270/58 X |
| 4,991,829 | 2/1991 | Fischer et al. | 271/9 |
| 5,000,432 | 3/1991 | Krasuski et al. | 270/45 |
| 5,060,838 | 10/1991 | Gergely, Jr. et al. | 225/100 |
| 5,067,699 | 11/1991 | Gadway et al. | 270/58 X |
| 5,104,104 | 4/1992 | Mol | 270/52 X |
| 5,104,105 | 4/1992 | Cote et al. | 270/58 X |

*Primary Examiner*—Edward K. Look
*Assistant Examiner*—John Ryznic
*Attorney, Agent, or Firm*—Charles R. Malandra, Jr.; Melvin J. Scolnick

[57] ABSTRACT

Thus the present invention provides an apparatus for conveying both individual sheets of paper and a web of forms having equally spaced, successive, transverse lines of weakening along a longitudinal path and for separating the forms along the transverse lines of weakening and merging the cut sheets and the separated forms for further processing. There is a transport section, superposed over the bursting section, including at least one upper and one lower belt and pulley assembly for conveying individual sheets along a second paper path, the second paper path merging into the first paper path, and structure for detaining the individual sheets at a position along the second paper path before the second paper path merges into the first paper path, whereby the individual sheets and the separated forms are thereafter processed along the first paper path.

13 Claims, 4 Drawing Sheets

APPARATUS AND SYSTEM FOR HANDLING CUT SHEETS AND WEB FORMS TO FORM DISCRETE BATCHES

FIELD OF THE INVENTION

This invention relates to document handling machines that assemble batches of documents, which may be sheets and/or web forms. More particularly, the present invention relates to the assembling of batches of documents in an inserting machine for insertion into envelopes.

BACKGROUND OF THE INVENTION

Inserting machines are known in the art and are generally used by organizations that generate large volume mailings wherein the contents of each item mailed may vary. Such machines typically comprise: feeder modules for separating and feeding single sheets, commonly referred to as cut sheets, from a stack of sheets into a batch or collation; web modules for separating webs into discrete forms and feeding the discrete forms into the batch; a transport/accumulation system for conveying sheets and form through the various modules to form proper batches; a folder module for folding the batches to a predetermined size; an inserter module for inserting the batches into envelopes; optionally meter modules for metering the envelopes with appropriate postage; and a control system to synchronize the operation of the modules in the inserting machine to assure that the batches are properly assembled, inserted into envelopes, and, optionally, metered.

Information for control of such known inserting machines is read from a control document, which is preferably a web form, by a scanner associated with the feeder module or web module that feeds the document. Preferably, that module is the most upstream module along the transport system. The scanner reads information from the control document which typically includes information such as information defining the number of documents to be inserted at each module, information providing an identification code for comparison with identification codes on inserted documents to assure that documents are properly matched, and, possibly, information for other purposes such as selection of postage. This control information is then transmitted to the control system which controls the operation of the inserter system accordingly to assure the proper assembly and processing of each batch as defined by a control document.

As noted above, control documents are preferably web forms since compilation of the control information for each batch is most readily done through data processing with output through a line printer onto a web of computer printout forms. Accordingly, inserting machines generally comprise an upstream web module, or modules, which feed discrete forms (i.e., a control form and optionally, one or more succeeding non-control forms from the web) for further processing, wherein appropriate forms would be accumulated to complete the batch which would be folded and inserted into an envelope. Such sheet inserter systems are known and typical examples are described in U.S. Pat. No. 3,606,728, issued Sep. 21, 1971, to Sather, et al. and assigned to Bell and Howell Co.; U.S. Pat. No. 3,955,429, issued Jan. 27, 1976, to Braneky, et al. and assigned to Pitney Bowes Inc.; and U.S. Pat. No. 4,547,856, issued Oct. 15, 1985, to Piotroski, et al. and assigned to Pitney Bowes Inc.

Web modules generally comprise a forms feeder which feeds a web of forms into a burster-folder, where the web is separated into discrete forms, which may be folded to fit into an envelope, if necessary, and a scanner which reads information from the web before bursting. The control information may be printed on the forms or the sprocket strips, the latter being used if the control information is to be removed with the sprocket strip. To prevent accidental premature bursting a slack loop of web is maintained between the forms feeder and the burster-folder. Typically, before the web is fed into the burster-folder the forms feeder removes the sprocket strips, which are used to drive the web, from the web. Accordingly, in inserting machines where control information is printed on the sprocket strips (in order not to print extraneous information on the form to be mailed) the scanner must be positioned to scan the web before the sprocket strips are removed. Web modules may also include an accumulator which accumulates a number of succeeding non-control forms with a control form and then feeds the accumulation in to a batch.

The mechanical construction and operation of web modules is well known by those skilled in the art as is, as mentioned above, the control, construction and operation of conventional sheet inserter systems. U.S. Pat. No. 4,395,255, issued Jul. 26, 1983, to Braneky, et al. and assigned to Pitney Bowes Inc., teaches typical web handling equipment.

U.S. Pat. No. 4,527,468, issued Jul. 9, 1985 to Piotroski and assigned to Pitney Bowes Inc., teaches an apparatus for separating multiple webs of documents into discrete documents and forming the discrete documents into predetermined batches. This apparatus has heretofore proved satisfactory for the automatic assembly of large volume mailings of varying items. However, it suffers the disadvantage that, in addition to the typical web feeder, each web module includes its own burster and its own accumulator, for separating the web into discrete forms and accumulating the discrete forms into sub-batches before the sub-batches are fed to the transport system to form batches for further processing. Another disadvantage to the multiple web apparatus is that the accumulation of the sub-batches cannot be done in-line with the transport system, thus requiring that the multiple web modules be configured parallel to one another with each having a paper path that is orthogonal to the path of the transport system. The aforementioned disadvantages result in a further disadvantage in the size and complexity of the inserting machine required to achieve this configuration.

In U.S. patent application Ser. No. 619,536, filed on Nov. 29, 1990, now U.S. Pat. No. 5,060,838, and assigned to the assignee of the present invention, a dual burster is disclosed which provides the capability to form batches in-line from two web feeders.

Heretofore, the batches folded by folder modules have been entirely comprised of either cut sheets or web forms. There is now a need to form batches consisting of a combination of cut sheets and forms, which must be accumulated and folded. The aforementioned apparatus do not provide for the accumulation of cut sheets and web forms to produce a batch for further processing.

SUMMARY OF THE INVENTION

It has been found that cut sheets can be accumulated with web forms to form a batch for further processing in an inserting machine. In accordance with the present invention, one of the web feeder sections on a dual buster module is replaced with a transport apparatus into which individual sheets are fed seriatim, for example, from a cut sheet feeder. It has been found that this arrangement provides a system for reading the control document, accumulating an appropriate number of web forms and the merging an appropriate number of individual sheets for accumulation with the web forms to form a batch for further processing.

In accordance with the present invention, a bi-level transport and burster apparatus comprises a separate transport path and a separate web feeding/burster path which merge into a single paper path. A feeder module is positioned to feed into the transport apparatus wherein individual sheets fed from the feeder module are merged with separated web forms to form produce batches consisting of sheets and forms. The present invention makes use of the clam shell housing from the aforementioned dual burster and in effect replaces the upper burster section with a transport and merge section for handling individual sheets. It has been found that with this arrangement a sheet feeder can be positioned upstream from a burster to feed sheets along a separate paper path and then merged with separated web forms to provide batches of sheets and web forms. The housing provides clamshell access to the burster paper path.

Thus the present invention provides an apparatus for conveying both individual sheets of paper and a web of forms having equally spaced, successive, transverse lines of weakening along a longitudinal path and for separating the forms along the transverse lines of weakening and merging the cut sheets and the separated forms for further processing. The apparatus comprises a longitudinally extending support structure, a bursting section including means for advancing a web of forms along a first paper path and means for bursting the web into separate forms and conveying the separate forms along the first paper path. There is a transport section, superposed over the bursting section, including at least one upper and one lower belt and pulley arrangement for conveying individual sheets along a second paper path, the second paper path merging into the first paper path, and means for detaining the individual sheets at a position along the second paper path before the second paper path merges with the first paper path whereby the individual sheets and the separated forms are thereafter processed along the first paper path.

BRIEF DESCRIPTION OF THE DRAWINGS

A complete understanding of the present invention maybe obtained from the following detailed description of the preferred embodiment thereof, when taken in conjunction with the accompanying drawings wherein like reference numerals designate similar elements in the various figures, and in which.

DETAILED DESCRIPTION OF THE PREFERRED EMBODIMENT

Figure 3:
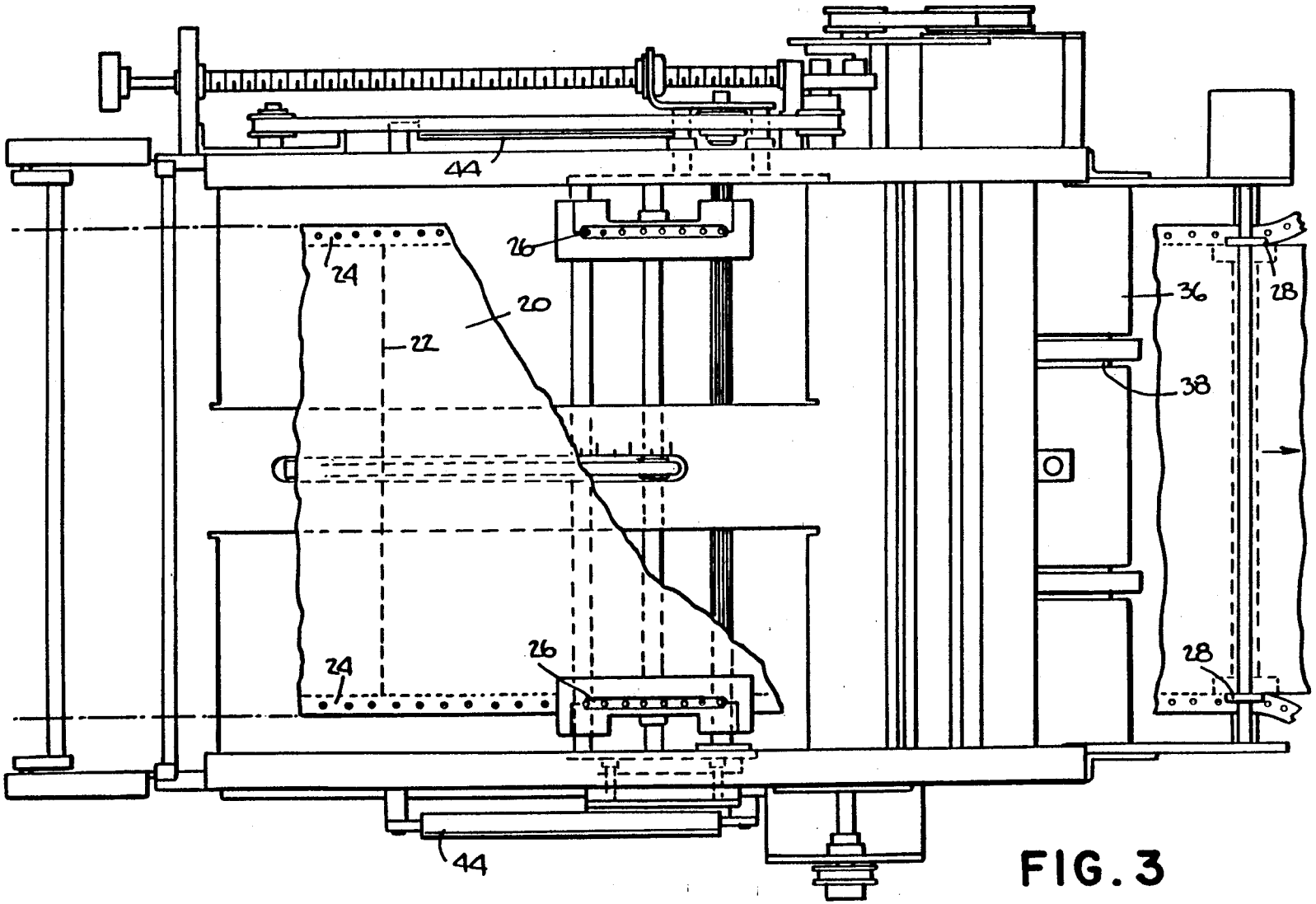
FIG. 3 is a top, plan view of the bursting section of apparatus of FIG. 1.

In describing the preferred embodiment of the present invention, reference is made to the drawings, wherein there is seen a combined transport/bursting apparatus, generally designated 10, including a transport and merge section, generally designated 11, and a bursting section, generally designate 12. Bursting section 12 includes a pair of lower, feed rollers 14 and 16 for feeding a web 20 of computer forms having transverse lines of weakening 22 defining separate forms. Web 20 initially includes sprocket strips 24 on either side (See FIG. 3) which are engaged by pairs of adjustable, eight pin needle bearing tractors 26 which feed web 20 to feed rollers 14 and 16. Situated downstream of feed rollers 14 and 16 is an adjustable bursting cone 32. It will be understood that alternate devices such as bursting balls can be used. Downstream of bursting cone 32 is a pair of stepper motor driven bursting rollers 34 and 36. Downstream of bursting rollers 34 and 36 are a pair of D.C. motor driven, sprocket strip trimmer 28 for removing sprocket strips 24 from web 20. Upstream of bursting cone 32 are a pair of plates 15 for guiding web 20 to bursting rollers 34 and 36.

Transport and merge section 11 includes a conventional belt and pulley assembly comprising a plurality of upper belts 50 extended over upper, upstream pulleys 52 and downstream pulleys 54, and a plurality of lower belts 60 extended over lower, upstream pulleys 62 and downstream pulleys 64. The upper reach of lower belts 60 and the lower reach of upper belts 50 operate to convey sheets fed into transport and merge section 11. There are a pair of stop rollers 66 and 68 which control the advancement of sheets being conveyed through transport and merge section 11. Downstream from the belt and pulley system are upper, feed rollers 70 and 72 and upper guide plates 74 for conveying sheets from the belt and pulley system to bursting rollers 34 and 36.

It can be seen that the two paper paths defined by the two pairs of feed rollers 70 and 72, and 14 and 16 converge into one paper path at the bursting rollers 34 and 36.

Figure 1:
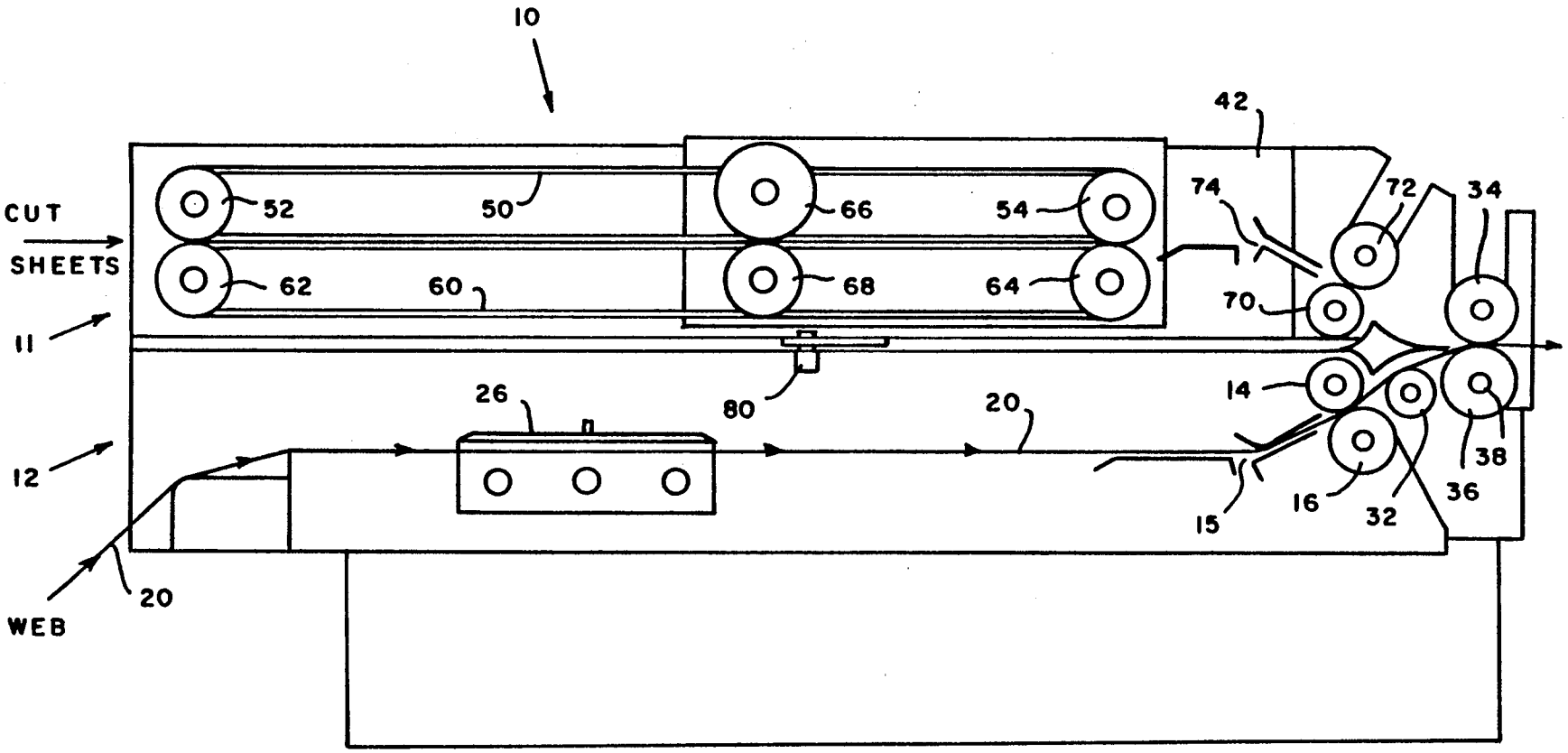
FIG. 1 is an side elevational view of a transport-/burster apparatus in accordance with the present invention.
Figure 2:
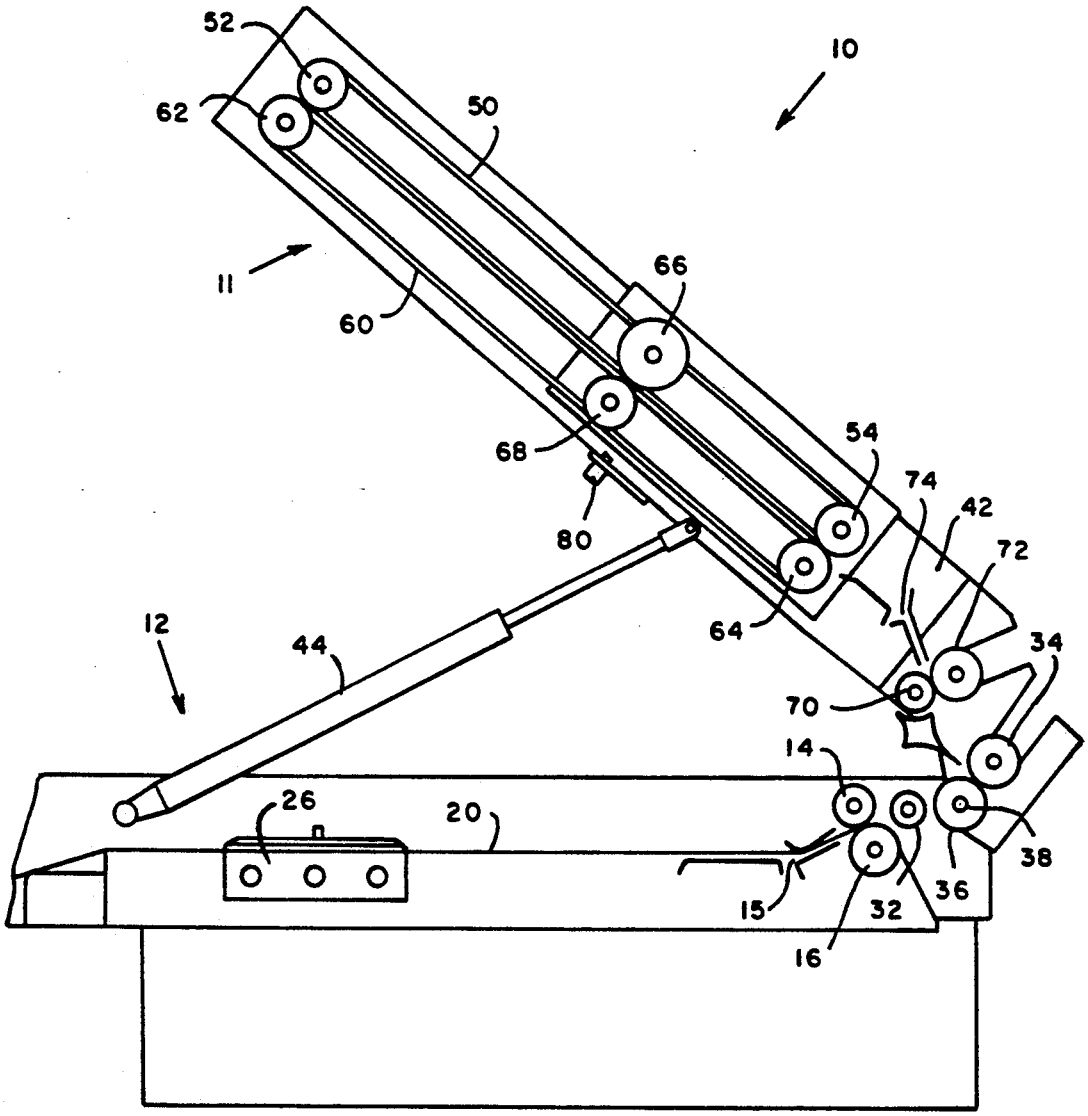
FIG. 2 is the apparatus of FIG. 1 in an opened condition to demonstrate the clamshell arrangement of the apparatus.

The lower bursting roller 36 is mounted on a shaft 38 on which are mounted a pair of yokes (not shown) which support the upper, clam-shell housing 42 for the aforesaid bursting apparatus. As best seen in FIG. 2, the clam-shell housing 42 supports the upper burst roller 36, the upper pair of feed rollers 70 and 72, and the belt and pulley assembly. An open construction of the clam-shell housing 42 provides ready access at all times to sheets in transport and merge section 11, and by virtue of its ability to pivot open as seen in FIG. 2, access is provided to the lower web 20. A commercially available gas spring 44 can be used to maintain clam-shell housing 42 in the open position so that jams can be cleared, or other problems involving the lower web 20 addressed. Downstream of bursting rollers 34 and 36 is a pair of transport rollers (not shown) for transporting the forms and sheets conveyed through rollers 34 and 36 for further processing.

In bursting section 12, there is a conventional scanning device 80 for scanning control information printed on control documents in the web. Typically, the control documents are leading forms for each batch of forms to be burst. In the preferred embodiment of the present invention, the control information includes the number of forms and the number of individual sheets that must be combined to complete a corresponding batch.

Figure 4A:
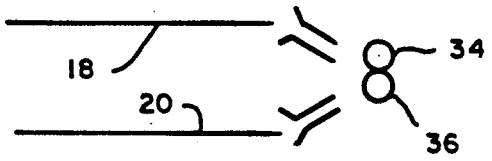
FIG. 4A is a schematic, side, elevational view of the paper paths in the apparatus of FIG. 1.
Figure 4B:
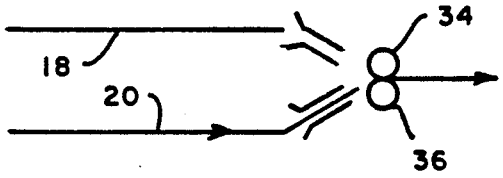
FIG. 4B is similar to FIG. 4A except that the web is shown being burst.
Figure 4C:
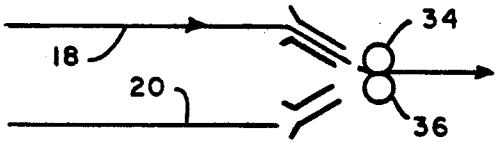
FIG. 4C is similar to FIG. 4B except that the individual sheets are being conveyed.

Referring now to FIGS. 4A–4C, the separate paper paths are shown merging into one paper path. As seen in FIG. 4B, web 20 is being burst and an individual sheet 18 has been detained at roller pairs 66 and 68. After a predetermined number of forms have been burst from web 20, a predetermined number of individual sheets 18 are conveyed through burst rollers 34 and 36, as seen in FIG. 4C. After the predetermined number of individual sheets 18 are conveyed, the cycle is repeated with the control document in the web being scanned to determine the number of forms and individual sheets that must be accumulated to form a predetermined batch.

Figure 5:
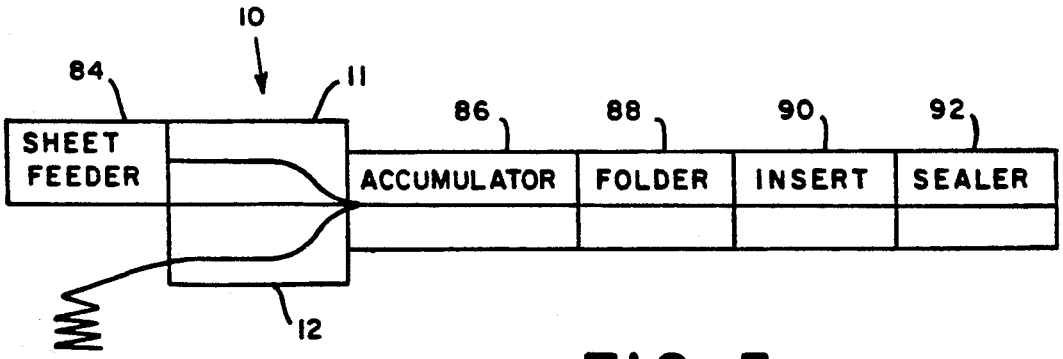
FIG. 5 is a schematic side view of an inserting machine with the apparatus of FIG. 1 configured therein.

Referring now to FIG. 5, there is shown an inserting machine configuration including transport and bursting apparatus 10 of the present invention. Cut sheet feeder 84 feeds individual sheets seriatim into transport and merge section 11, and web 20 is fed and burst in bursting section 12. According to scanned control information, separated web forms and individual sheets are merged into one paper path and accumulated into batches at accumulator module 86. Each completed batch is conveyed to folder module 88 for folding, and then to insert module 90 for insertion into an envelope which is then moistened and sealed at sealer module 92. It will be understood by those skilled in the art that there are other applications and configurations of inserting machines employing the present invention. For example, individual sheets 18 and separated forms 20 can be transported directly to folder module 88 for folding, whereby accumulator module 86 operates as a transport.

The steps required to operate the apparatus include determining the length of the discrete forms in webs 20 by a strip length gauge having numerical increments representing varying form lengths. This number is now used to position the tractors 26 to a numerically equivalent gauge setting on the paper path deck to a position such that the first form will be completely scanned and the lead edge of this form will advance, when the apparatus is energized to a position coincident with the center of the burst rollers 34 and 36. This number is also entered by the operator into a pulse counting device(s) (thumbwheels) for the lower paper path prior to the operation of the apparatus. The feed rollers for the lower paper path can be driven intermittently or continuously, dependent on whether a collated set or one form/sheet from each paper path is programmed. Upstream from the burst cone 30 and 32 but downstream from the feed rollers 70, 72, 14 and 16 is positioned a sensing device (not shown) that detects the leading edge of a form/sheet from either paper path and sends an appropriate signal to a pulse generator connected to the burst rollers 34 and 36. By means of the pulse counting device(s) previously set by the operator and coincident with the leading edge of the form being sensed, a pulse count is reached that accelerates the burst rollers 34 and 36 at the appropriate time and duration to a speed that effectively bursts the form as the rollers convey the form away from web 20. Prior to accelerating, the burst rollers 34 and 36, driven by a separate stepper motor (not shown), are rotating at the same speed as lower feed rollers 14 and 16 and tractor carriage assembly 26, which are synchronized and driven by stepper motors. On exiting the burst rollers 34 and 36, the leading edge of the untrimmed form will enter the trimmers 28 which were manually positioned to trim off the sprocket strips that exit in a downward direction while the trimmed and burst form 20 proceeds to the next downstream device.

The belt and pulley assembly and upper feed roller 70 and 72 of transport and merge section 11 and stop rollers 66 and 68 rotate at the same speed as burst rollers 34 and 36 and are driven by D.C. motors. The belt and pulley assembly and feed rollers 70 and 72 rotate continuously. Stop rollers 66 and 68 are controlled by a conventional clutch/brake assembly for detaining individual sheets while forms are burst in bursting section 12.

This cycle is repeated continuously with no stopping or delaying of the feed or burst rollers on any one up (single web) application of collated sets and will stop only when an end of collation is detected by the scanning device or when the sense device does not see a gap between forms which would indicate a stream feed (unburst form) condition.

This transport/bursting machine can also be used in nonintelligent (no scanning) applications requiring one form and one individual sheet per cycle.

It should be understood by those skilled in the art that various modifications may be made in the present invention without departing from the spirit and scope thereof, as described in the specification and defined in the appended claims.

What is claimed is:

1. Apparatus for separating forms of a web along a first paper path and conveying individual sheets of paper along a second paper path and subsequently processing the individual sheets and separated forms along a single paper path, comprising:

a longitudinally extending support structure;

a bursting section located at an upstream end of said support structure, said bursting section including means for advancing the web of forms along the first paper path and means for separating the web of forms into separated forms and subsequently conveying the separated forms along the first paper path;

a transport section, superposed over said bursting section, said transport section including at least one upper and lower belt and pulley assembly for conveying the individual sheets along the second paper path; and means for merging the second paper path into the first paper path at a merge location, wherein said transport section further includes means for detaining the individual sheets at a detaining position along the second paper path when the separated forms are being separated and conveyed past said merge location, whereby said individual sheets and said separated forms are thereafter processed along the first paper path.

2. The apparatus according to claim 1 wherein said merge location is at said separating means.

3. Apparatus for conveying both individual sheets of paper and a web of forms having equally spaced, successive, transverse lines of weakening along a longitudinal path and for separating the forms along said transverse lines of weakening and merging the cut sheets and the separated forms for further processing, comprising:

a longitudinally extending support structure;

a bursting section including means for advancing the web of forms along a first paper path and means for bursting said web into separate forms and conveying said separate forms along said first paper path;

a transport section, superposed over said bursting section, including at least one upper and one lower belt and pulley assembly for conveying individual sheets along a second paper path, said second paper path merging into said first paper path, and means for detaining the individual sheets at a position along said second paper path before said second paper path merges into said first paper path, whereby said individual sheets and said separated forms are thereafter processed along said first paper path;

wherein said means for bursting includes a bottom pair of upper and lower, vertically spaced feed rollers rotatably supported by said structure, and a pair of upper and lower, vertically spaced burster rollers, said lower burster roller having a shaft and being rotatably supported by said structure downstream of said bottom feed rollers;

said transport section including a clam shell housing pivotably mounted on said lower burster roller shaft, wherein said upper burster roller is supported by said clam shell housing; and a top pair of upper and lower, vertically spaced feed rollers rotatably supported by said clam shell housing.

4. The apparatus according to claim 3 wherein said bursting means includes a bursting cone downstream of said bottom pair of feed rollers and upstream of said bursting rollers, said bursting cone supported by said longitudinally extending support structure.

5. Apparatus for conveying both individual sheets of paper and a web of forms having equally spaced, successive, transverse lines of weakening along a longitudinal path and for separating the forms along said transverse lines of weakening and into one paper path merging the cut sheets and the separated forms for further processing, comprising:

a longitudinally extending support structure;

a bursting section including means for advancing the web of forms along a first paper path and means for bursting said web into separate forms and conveying said separate forms along said first paper path;

a transport section, superposed over said bursting section, including at least one upper and one lower belt and pulley assembly for conveying individual sheets along a second paper path, said second paper path merging into said first paper path at a merge location, and means for detaining the individual sheets at a detaining position along said second paper path when said separate forms are conveyed past said merge location, whereby said individual sheets and said separated forms are thereafter processed along said first paper path.

6. The apparatus according to claim 5 wherein said means for bursting includes a bottom pair of upper and lower, vertically spaced feed rollers rotatably supported by said structure, and a pair of upper and lower, vertically spaced burster rollers, said lower burster roller having a shaft and being rotatably supported by said structure downstream of said bottom feed rollers.

7. The apparatus according to claim 6 wherein said means for bursting further includes a bursting cone downstream of said bottom pair of feed rollers and upstream of said bursting rollers, said bursting cone supported by said longitudinally extending support structure.

8. The apparatus according to claim 7, wherein said bursting section further includes means for scanning control information printed on said web forms.

9. The apparatus according to claim 6 wherein said transport section further includes a clam shell housing pivotably mounted on said lower burster roller shaft, wherein said upper burster roller is supported by said clam shell housing, and a top pair of upper and lower, vertically spaced feed rollers rotatably supported by said clam shell housing.

10. The apparatus according to claim 9 wherein said transport section further includes means for merging said second paper path into said first paper path.

11. The apparatus according to claim 10 wherein said guide means includes guide plates interposed between said top pair of feed rollers, said guide plates being situated to guide the individual sheets towards said bursting rollers.

12. The apparatus according to claim 9, additionally comprising a spring for maintaining said clam shell housing in an open position to thereby provide access to said bursting section.

13. The apparatus according to claim 9, wherein said detaining means includes a pair of stop rollers positioned upstream to said top pair of feed rollers.

* * * * *